US008025193B1

(12) United States Patent
Gornall, Jr.

(10) Patent No.: US 8,025,193 B1
(45) Date of Patent: Sep. 27, 2011

(54) RIFLE HOLDER DEVICE

(75) Inventor: Robert Douglas Gornall, Jr., Erie, PA (US)

(73) Assignee: Globe Industries, Inc., Houston, TX (US)

( * ) Notice: Subject to any disclaimer, the term of this patent is extended or adjusted under 35 U.S.C. 154(b) by 297 days.

(21) Appl. No.: 12/455,365

(22) Filed: Jun. 1, 2009

Related U.S. Application Data

(60) Provisional application No. 61/129,116, filed on Jun. 5, 2008.

(51) Int. Cl.
*A45F 5/00* (2006.01)

(52) U.S. Cl. ..... 224/268; 224/269; 224/270; 224/271

(58) Field of Classification Search ..... 224/268, 224/149, 150, 913, 269, 270, 271
See application file for complete search history.

(56) References Cited

U.S. PATENT DOCUMENTS 612,298 A * 10/1898 Zuberbier ..... 224/258
1,469,285 A * 10/1923 Thompson ..... 224/270
2,526,768 A * 10/1950 Pendergrass ..... 224/182
2,574,143 A * 11/1951 Colby ..... 224/182
2,856,111 A * 10/1958 Wolfe et al. ..... 224/268
3,022,898 A * 2/1962 Loeb ..... 211/64
3,187,967 A * 6/1965 Somple ..... 224/150
3,211,351 A * 10/1965 Somple ..... 224/150
3,501,074 A * 3/1970 Emerick ..... 224/606
3,963,156 A * 6/1976 Perrin ..... 224/268
4,431,122 A * 2/1984 Garmong ..... 224/268
5,564,610 A * 10/1996 Barron ..... 224/268
5,687,892 A * 11/1997 Johns ..... 224/268
7,175,061 B2 * 2/2007 Dohn ..... 224/673
2001/0008246 A1 * 7/2001 Grover ..... 224/247

* cited by examiner

*Primary Examiner* — Justin Larson
*Assistant Examiner* — Lester L Vanterpool
(74) *Attorney, Agent, or Firm* — Michael F. Scalise

(57) ABSTRACT

A rifle holder device for supporting a rifle in a position that is easy to grab for taking a shot is described. The holder device lets a hunter or shooting enthusiast carry a rifle with its weight supported on either his right or left hip. Rifles are rather heavy weapons. Should the hunter or shooting enthusiast carry one in his hands or arms for an extended period of time, his muscles can get fatigued. This makes it more difficult to get off an accurate shot in a timely manner. However, the present holder device puts most of the rifle's weight on the hunter's hip, thereby freeing his hands and arms from having to carry the rifle until it's time to take a shoot. Further, the present holder device is adjustable for carrying rifles of many different sizes.

20 Claims, 7 Drawing Sheets

RIFLE HOLDER DEVICE

CROSS-REFERENCE TO RELATED APPLICATION

This application claims priority from U.S. provisional patent application Ser. No. 61/129,116, filed Jun. 5, 2008.

BACKGROUND OF THE INVENTION

The present invention generally relates to a device for helping a hunter or shooting enthusiast carry a rifle. More particularly, the present invention relates to a holder device that can be worn on either the right or the left hip for cradling a rifle in a horizontal carrying position. Then, when the hunter or shooting enthusiast wants to shoot at a target, he can easily reach the rifle and remove it from the holder device for taking aim.

SUMMARY OF THE INVENTION

The present rifle holder comprises a hip plate that is adjustable worn by a hunter or shooting enthusiast on either his right or left hip. The holder device comprises a hip plate that rests against the hip. A pair of protrusions extends outwardly from the hip plate, each adjustably connected to a cradle portion. The protrusions and their associated cradles form spaced apart U-shaped recesses for supporting the rifle therein. The connections between the protrusions and the cradles are spring biased to hold the rifle in a firm manner. Further, the distance between each cradle and protrusion is adjustable for carrying rifles of different sizes.

With the holder secured to the hunter's or shooting enthusiast's hip by a waist belt and a shoulder belt, the shooter can walk or stand for an extended period of time without having to touch the rifle. Then, when the hunter or shooting enthusiast wants to take a shot at a target, he can easily reach the rifle and remove it from the holder to assume a shooting position. In that respect, the shooter's arms and hands don't become fatigued from holding the rifle for a long period of time. Rifles are rather heavy weapons. Should a hunter or shooting enthusiast carry one in his hands or arms for an extended period of time, his muscles can get fatigued. This makes it more difficult to get off an accurate shot in a timely manner. However, the present rifle holder puts most of the rifle's weight on the hip, thereby freeing his hands and arms from having to carry the rifle until it's time to take a shoot.

These and other objects of the present invention will become increasingly more apparent to those skilled in the art by reference to the following detailed description read in conjunction with the appended drawings.

DETAILED DESCRIPTION OF THE PREFERRED EMBODIMENTS

Figure 1:
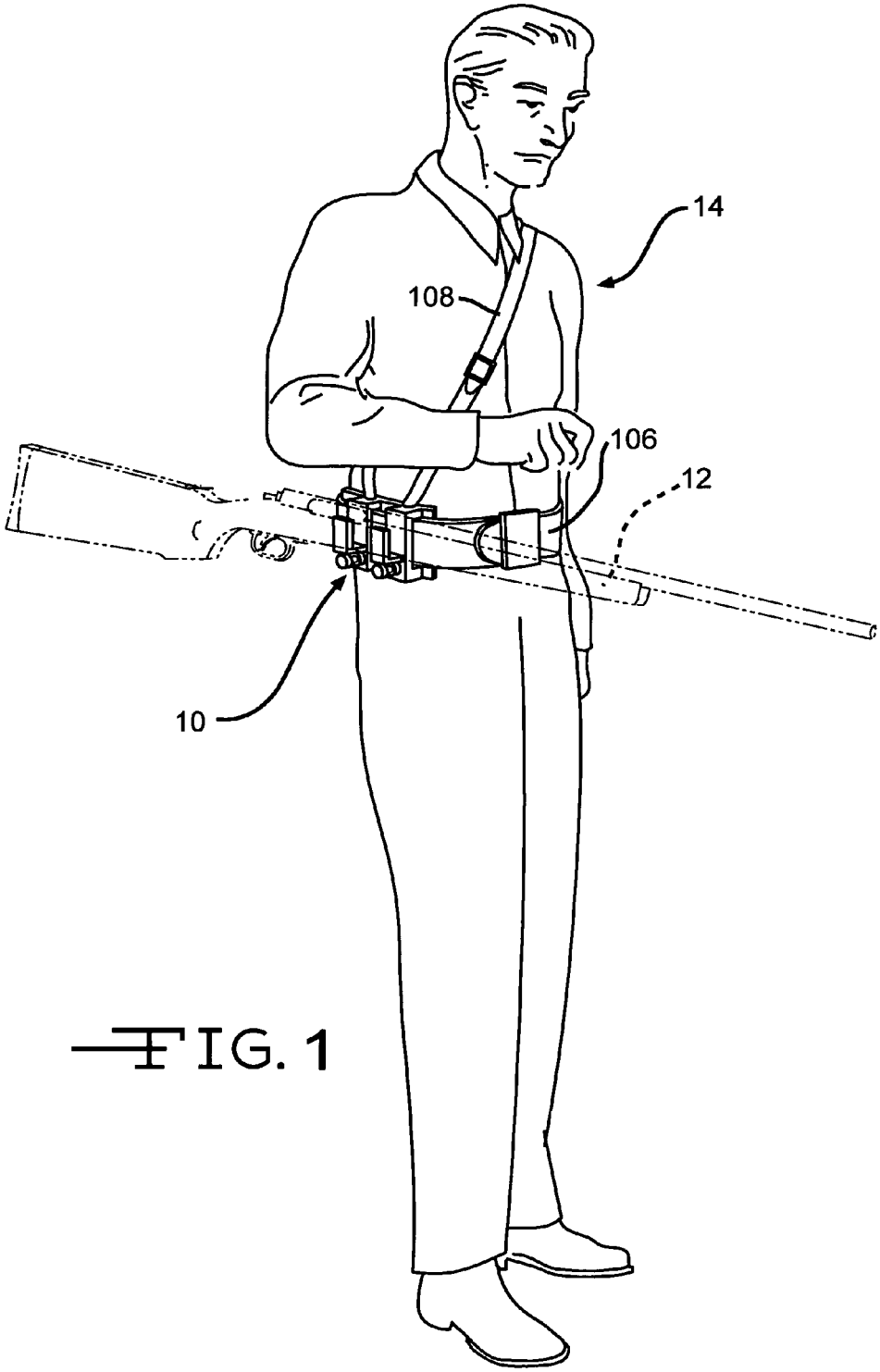
FIG. 1 is a perspective view of a hunter 14 carrying a rifle 12 on his right hip cradled in the gun holder 10 of the present invention.
Figure 2:
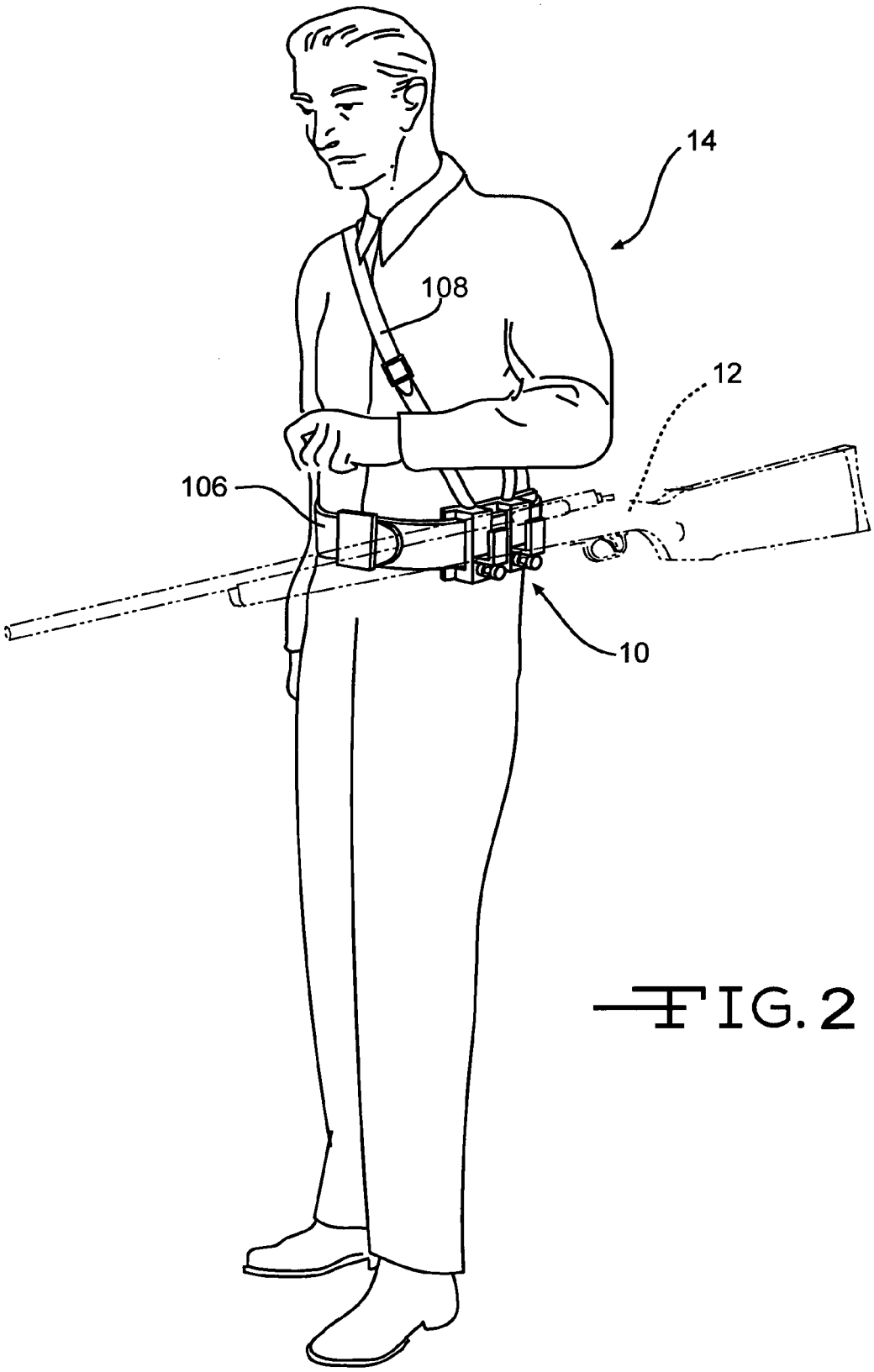
FIG. 2 is a perspective view of the hunter 14 carrying the rifle 12 on his left hip using the present gun holder 10.

Turning now to the drawings, FIGS. 1 and 2 illustrate the present gun holder 10 being used with a rifle 12 (shown in dashed lines) by a hunter 14. The gun holder 10 is interchangeably capable of supporting the rifle 12 on the right (FIG. 1) or left hip (FIG. 2) of the hunter.

Figure 3:
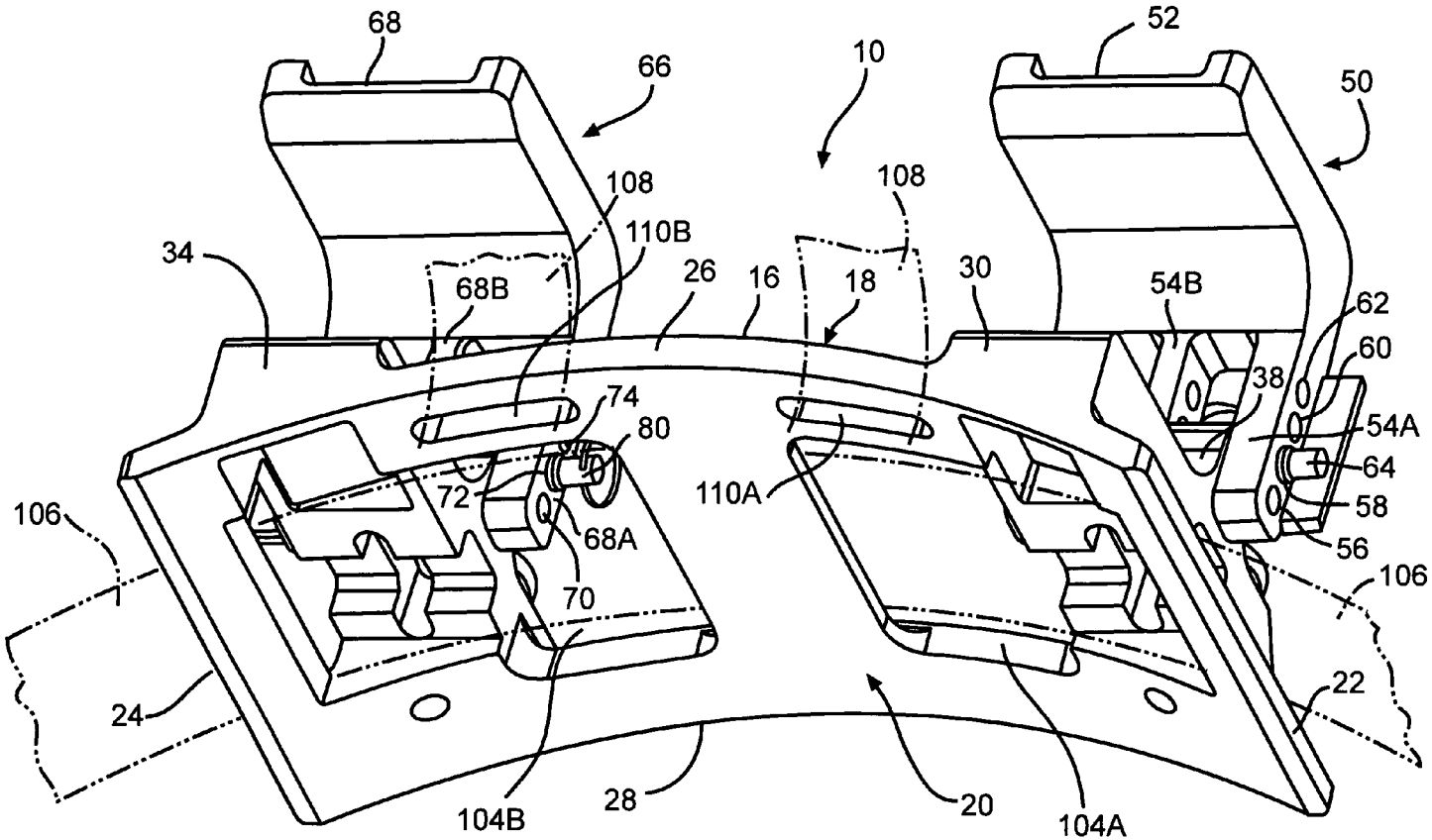
FIG. 3 is a perspective view of the gun holder 10, looking outwardly from behind the hip plate 16.

As shown in FIG. 3, the gun holder 10 is comprised of a hip plate 16 having a thickness defined between a curved inner surface 18 and a curved outer surface 20. Both the inner and outer surfaces 18, 20 extend from spaced apart first and second ends 22 and 24 to upper and lower edges 26 and 28.

A first protrusion 30 extends outwardly from the hip plate 16 adjacent to the first end 22. The first protrusion 30 has a first planar face 32 that extends substantially the entire height of the hip plate 16 from the upper edge 26 to the lower edge 28 thereof. Similarly, a second protrusion 34 extends outwardly from the hip plate 16 adjacent to the second end 24. The second protrusion 34 has a second planar face 36 that extends between the upper and lower edges 26, 28 thereof. The first and second planar faces 32, 36 of the respective first and second protrusion portions 30, 34 are co-planar.

Figure 6:
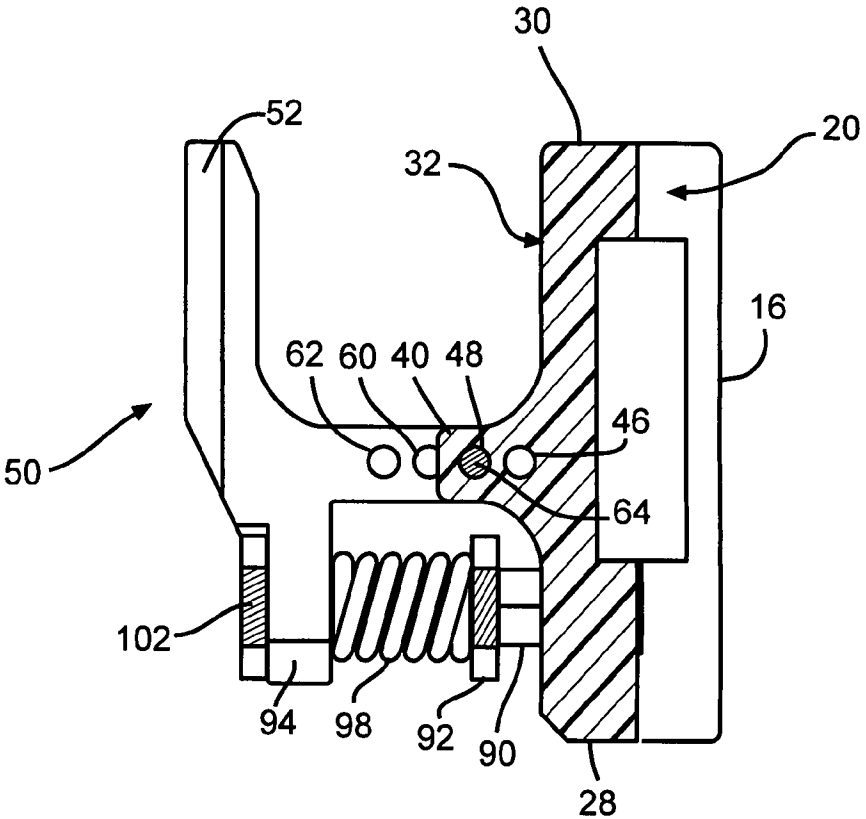
FIG. 6 is a cross-sectional view along line 6-6 of FIG. 4.

A first pair of spaced apart legs 38 and 40 protrudes outwardly from the first planar face 32 of the first protrusion portion 30. Similarly, a second pair of spaced apart legs 42 and 44 protrudes outwardly from the second planar face 36 of the second protrusion portion 34. As shown in FIG. 6, a pair of spaced apart bores 46 and 48 communicates through each of the first pair of legs 38 and 40. The leg bores 46 and 48 are aligned with each other with their longitudinal axes being parallel to the planar face 32 of the first protrusion portion 30. The bores 46 through each of the legs 38, 40 are closer to the second planar face 32 than the bores 48.

The second protrusion 34 is provided with a similar structure as the first protrusion 30. In that respect, the second protrusion 34 comprises a pair of spaced apart bores (not shown) that communicate through each of the second pair of legs 42, 44. These bores are aligned with each other. Their longitudinal axes are parallel to the planar face 36 of the second protrusion 34, with one bore being closer to the face than the other.

As shown in FIGS. 3 to 5 and 7, a first cradle 50 is adjustably supported by the first protrusion 30. The first cradle 50 is an L-shaped member comprising an upstanding portion 52 extending from a lower fork 54. The fork portion 54 has three fingers 54A, 54B and 54C, each having four bores 56, 58, 60 and 62 extending there through and aligned with each other. The longitudinal axes of the bores 56, 58, 60 and 62 are parallel to the face of the upstanding portion 52 of the first cradle 50.

The first cradle 50 is adjustably connected to the first protrusion 30. That is done by moving the cradle fingers 54A, 54B and 54C into engagement with the protrusion legs 38 and 40. When properly aligned, the first finger 54A is immediately adjacent to the outer surface of the first leg 38, the second finger 54B is intermediate the first and second legs 38 and 40 and the third finger 54C is immediately adjacent to the outer surface of the second leg 40. In this position, at least one of the bores 56, 58, 60 and 62 in the fingers 54A, 54B and 54C is aligned with at least one of the bores 46, 48 in the legs 38 and 40. A hinge pin 64 is received in the aligned bore in the legs 38, 40 and in the fingers 54A, 54B and 54C. In FIGS. 3 to 6, the hinge pin 64 resides in the bore 48 in legs 38 and 40 and in the bore 58 of the fingers 54A, 54B and 54C, thereby securing the first cradle 50 to the first protrusion 30.

A second cradle 66 is adjustably supported by the second protrusion 34. In a similar manner as the first cradle 50, the second cradle 66 is an L-shaped member comprising an upstanding portion 68 extending from a lower fork 70. The fork portion 70 has three fingers 70A, 70B and 70C, each having four bores 72, 74, 76 and 78 extending there through and in alignment with each other. The longitudinal axes of the bores 72, 74, 76 and 78 are parallel to the face of the upstanding portion 68 of the second cradle 66.

Figure 4:
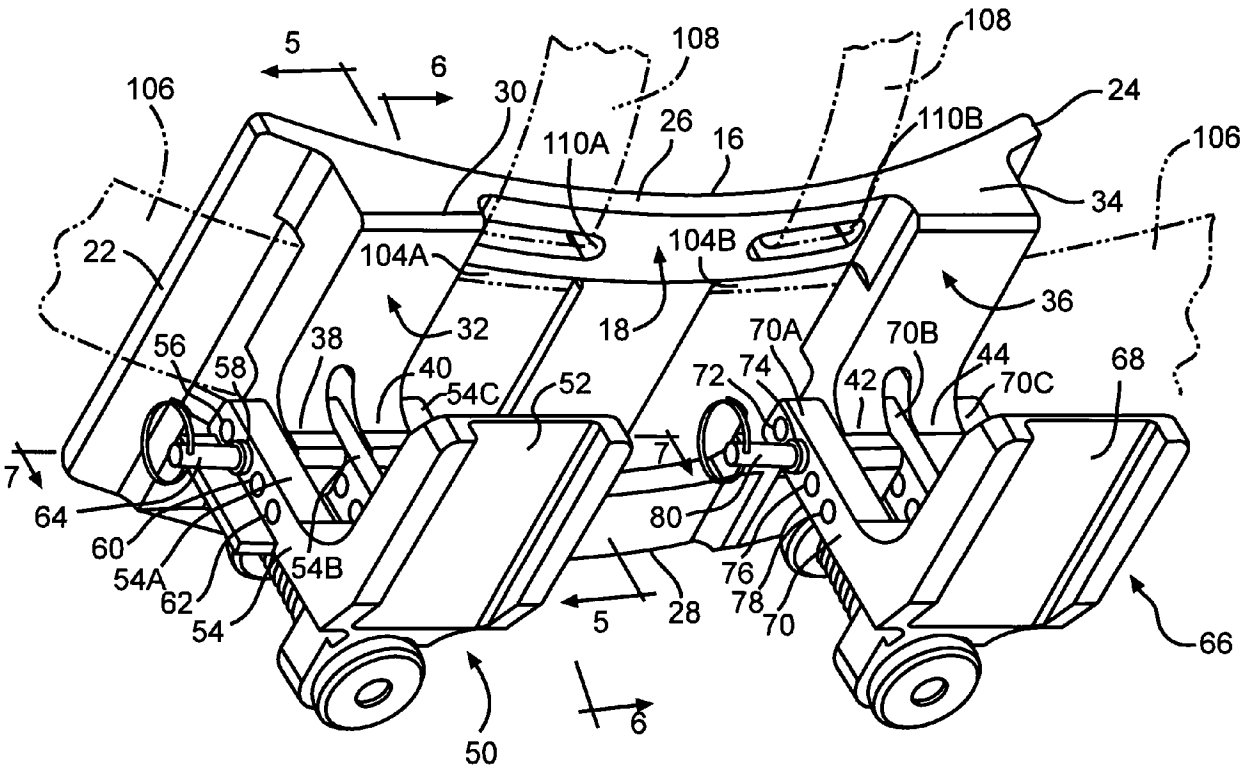
FIG. 4 is a perspective view of the present gun holder 10, looking inwardly from in front of the hip plate 16.

In a similar manner as the first cradle 50 is adjustably connected to the first protrusion 30, the second cradle 66 is adjustably connected to the second protrusion 34. That is done by moving the cradle fingers 70A, 70B and 70C into engagement with the protrusion legs 42 and 44. When properly aligned, the first finger 70A is immediately adjacent to the outer surface of the first leg 42, the second finger 70B is intermediate the first and second legs 42 and 44 and the third finger 70C is immediately adjacent to the outer surface of the second leg 44. At least one of the bores 72, 74, 76 and 78 in the fingers 70A, 70B and 70C is aligned with at least one of the bores in the legs 42 and 44. A hinge pin 80 is received in the aligned bore in the legs 38, 40 and in the fingers 70A, 70B and 70C of the fork 70. In FIGS. 3 and 4, the hinge pin 80 resides in bore 74 of the fingers 70A, 70B and 70C and one of the bores in the legs 42 and 44, thereby secures the second cradle 66 to the second protrusion 34.

It should be pointed out that while the present invention has been described with the protrusions 30, 34 each having two legs, that is the minimum number required. If desired, the protrusions 30, 34 can have three or more legs, and the protrusions need not necessarily have the same number of legs. Also, the protrusion legs need not necessarily have two bores there through. There can be one or more that two protrusion bores. Similarly, the cradles 50, 66 need not have three fingers. Instead, they can have one, two or more than three fingers. Further, there need not be four bores through each of the cradle fingers. Rather, there can be one, two, three or more than four bores as a particular design may dictate. However, it is preferred that either there is one more leg than fingers, or vice versa. The number of aligned bores provided in each leg is preferably the same. Similarly, the number of aligned bores provided in each finger is preferably the same.

Figure 5:
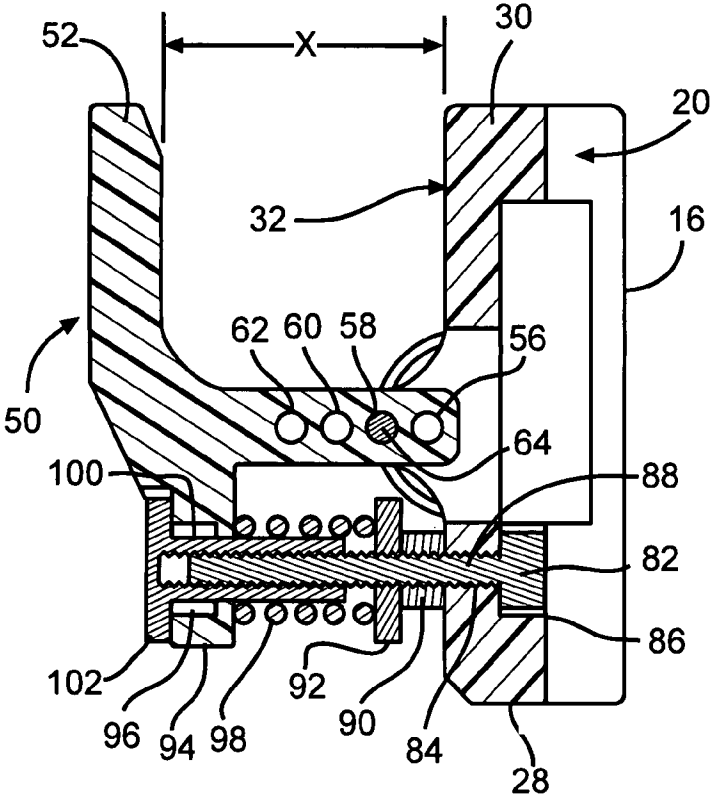
FIG. 5 is a cross-sectional view along line 5-5 of FIG. 4.
Figure 7:
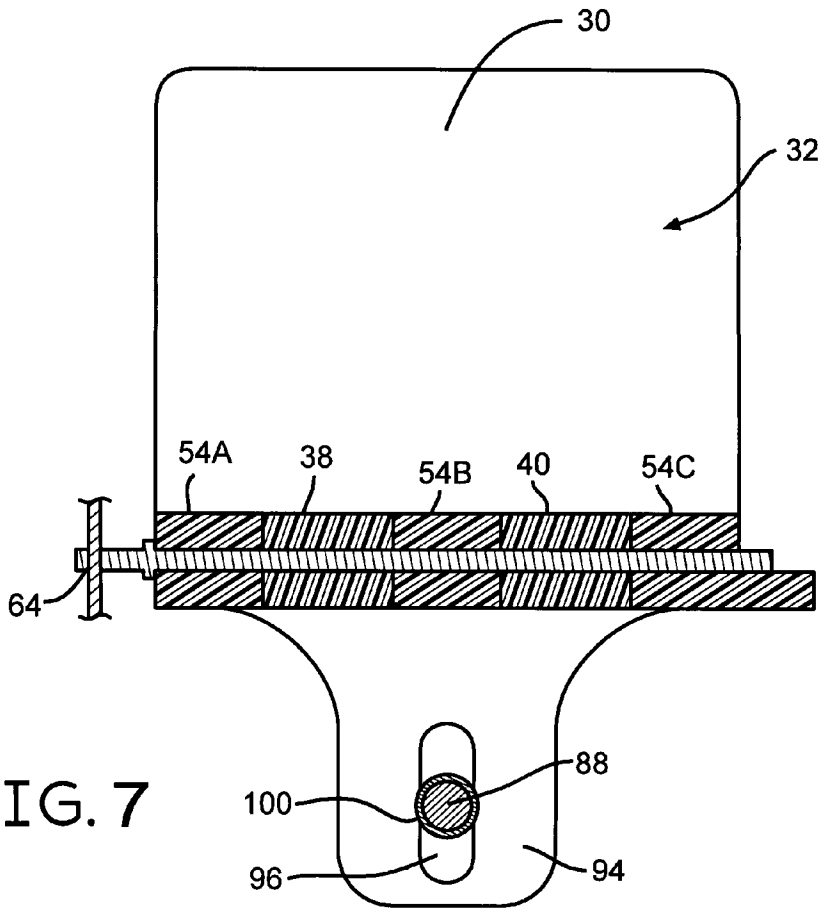
FIG. 7 is a cross-sectional view along line 7-7 of FIG. 4.

In order to adjust the stiffness between each of the protrusion/cradle pairs 30, 50 and 34, 66, a tensioning structure is provided. FIGS. 5 and 6 illustrate the tensioning structure comprising a threaded bolt 82 protruding through an opening 84 in the protrusion 30 adjacent to the lower edge 28 of the hip plate 16. The head of the bolt 82 is captured in a recess 86 in the plate 16 with the threaded shaft 88 extending outwardly toward the cradle 52. The bolt 82 is fastened in this position by a nut 90 threaded thereon to abutting the face 32 of the protrusion 30. A threaded washer 92, preferably having a knurled surface for ease of manipulation, is threaded onto the bolt 82 abutting the nut 90.

The cradle 50 further includes a depending portion 94 provided with an oval-shaped slot 96 therein. The long axis of the oval is aligned generally normal to the longitudinal axis of the hinge pin 94. A coil spring 98 of a relatively stiff tension is fitted on the free end of the bolt 82.

A threaded sleeve 100 comprising a cylindrical portion having internal treads connected to knurled washer portion 102 as a unitary member is threaded onto the bolt 82. The sleeve 100 extends through the oval-shaped slot 96 in the depending portion 94 of the cradle 50 residing inside the coil spring 98. In this position, the knurled washer 102 abuts the depending cradle portion 94. That way, the coil spring 98 is captured between the depending cradle portion 94 and the threaded washer 92.

In an alternate embodiment of the present rifle holder, the nut 90 and the washer 92 can be combined as one member. All that is needed is for a threaded member to reside on the shaft 88 of the bolt 82 abutting the hip plate 16 to secure the bolt 82 in place.

In still another alternate embodiment of the present rifle holder, the bolt 82 extends through the oval-shaped opening 96. In that position, the threaded sleeve 100 has its washer portion 102 received in the opening 84 with the cylindrical portion of the threaded sleeve 100 extending toward the cradle 50 from the hip plate 16. The threaded bolt 82 has its head received in the oval-shaped slot 96 in the depending portion 94 of the cradle 50. The threaded shaft 88 of the bolt 82 is then threadingly received in the threaded cylindrical portion of the sleeve 100 with the coil spring 98 captured between the depending cradle portion 94 and the threaded washer 92 abutting the nut 90 seated against the inner surface of the depending cradle portion 94.

FIG. 5 shows an alignment where the planar face 32 of the first protrusion 30 is substantially parallel to the face of the upstanding portion 52 of the cradle 50. This constant distance between the upstanding portion 52 and the planar face 32 is designated by "x".

Figure 9:
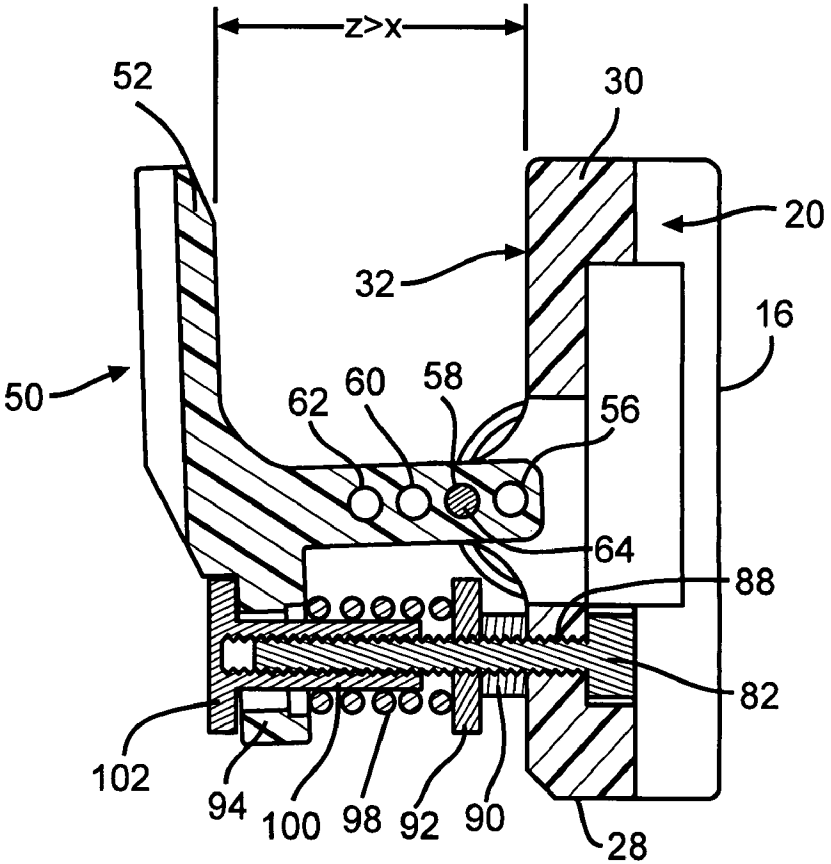
FIG. 9 is a side, cross-sectional view showing the cradle 50 adjusted outwardly away from the hip plate 16.
Figure 8:
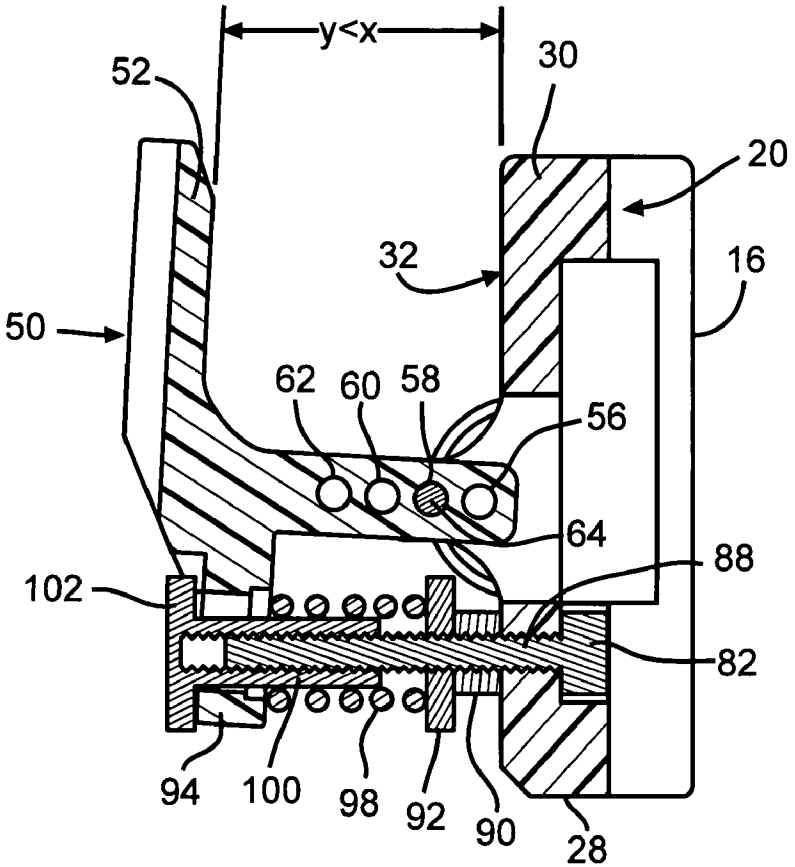
FIG. 8 is a side, cross-sectional view showing the cradle 50 adjusted inwardly toward the hip plate 16.

FIGS. 8 and 9 illustrate two adjusted positions of the connection between the protrusion 30 and the cradle 50. This enables the hunter 14 (FIGS. 1 and 2) to adjust the distance between the planar face 32 and the upstanding portion 52 to accommodate a rifle 12 of different sizes. In FIG. 8, the distance between the upstanding portion 52 and the planar face is designated "$y<x$". This is done by unthreading the washer 102 and sleeve 100 from the bolt 82. As the washer moves away from the bolt 82, the coil spring 98 biasing against the depending cradle portion 94 causes the cradle 50 to pivot on the hinge pin 64 with respect to the protrusion 30. As the depending cradle portion 94 moves away from the bolt 82 and, consequently, the protrusion 30, the upstanding portion 52 moves closer thereto.

Conversely, as shown in FIG. 9 the distance between the upstanding portion 52 and the planar face is designated "$z>x$". This is done by threading the washer 102 and sleeve 100 into tighter engagement with the bolt 82. As the washer moves toward from the bolt 82, the coil spring 98 biasing against the depending cradle portion 94 is compressed. This causes the cradle 50 to pivot on the hinge pin 64 with respect to the protrusion 30. As the depending cradle portion 94 moves toward the bolt 82 and, consequently, the protrusion 30, the upstanding portion 52 moves away from the protrusion.

Accordingly, the present gun holder 10 is easily adjusted to fit rifles of many different sizes and makes. As previously described, the gun holder 10 can be worn by both right and left handed hunters 14. The hip plate 16 includes cut-out portions 104A, 104B behind the first and second protrusions 30, 34. An adjustable waist belt 106 (FIGS. 1 to 4) received in these openings lets the hunter wear the gun holder at a comfortable position on either his right side (FIG. 1) or his left side (FIG. 2). A shoulder strap 108 has its opposite ends secured to spaced apart openings 110A and 110B adjacent to the respective protrusions 30, 34 near the upper edge 26 of the hip plate. The shoulder strap 106 is worn across the shoulder opposite the side hip against which the plate 16 rests. That way, the shoulder strap helps secure the gun holder 10 in position, especially when it is being used to carry a heavy rifle 12.

Thus, it can be seen that the present gun holder 10 is a device that is comfortable to wear by hunters who are either right or left handed. Further, the gun holder 10 is readily adjustable to holds virtually any size rifle 12 in a position where it can be easily reached for aiming and firing. In that respect, while the adjustable cradles 50 and 66 are designed to firmly hold the rifle, that firmness is not so great that the hunter can't easily remove the rifle from the holder 10 to take aim and fire at a target.

The present invention is not intended to be limited by the described embodiments, but by the herein appended claims.

What is claimed is:

1. A rifle holder device, which comprises:

a) a hip plate comprising an inner surface intended to rest against the hip of a user and an outer surface, wherein at least a portion of the outer surface of the hip plate has a generally vertical orientation when the rifle holder device is being worn;

b) at least one leg extending outwardly from the outer surface of the hip plate, wherein the at least one leg has at least one leg bore extending there through, the leg bore axis being aligned generally in a horizontal orientation;

c) at least one cradle adjustably connected to the hip plate and comprising an upstanding cradle portion extending from a lower cradle fork, the cradle fork comprising at least one cradle finger with there being either one more or one less cradle finger than there are legs extending from the hip plate, the at least one cradle finger having at least one finger bore extending there through, the cradle finger bore being aligned generally in a horizontal orientation and wherein the cradle is connectable to the hip plate with either two cradle fingers residing on either side of the at least one leg of the hip plate or two legs residing on either side of the at least one cradle finger and with the leg bore aligned with the cradle finger bore;

d) a pivot pin received in the aligned leg bore and the finger bore to connect the cradle to the hip plate;

e) a depending cradle portion extending downwardly from the cradle below the at least one cradle finger;

f) a threaded member comprising a threaded member head and a threaded shaft, wherein the threaded member head is received in an opening in the hip plate with the threaded shaft extending in a horizontal orientation spaced below the at least one cradle finger connected to the at least one leg of the hip block;

g) a threaded sleeve threadingly received on the shaft of the threaded member with a sleeve head abutting an outer surface of the depending cradle portion;

h) a coil spring residing on the cylindrical portion of the threaded sleeve threadingly received on the shaft of the threaded member and captured between the depending cradle portion and the hip plate;

i) wherein the threaded relationship between the threaded sleeve and the shaft is adjustable against the biasing force of the coil spring to adjust the tension between the cradle and the hip plate pivoting on the pivot pin to thereby adjust a holding force exerted on a rifle received between the hip plate and the cradle.

2. The rifle holder device of claim 1 wherein the cradle is L-shaped.

3. The rifle holder device of claim 1 wherein the at least one leg extends outwardly from a protrusion portion of the hip plate.

4. The rifle holder device of claim 3 wherein there are at least two legs extending outwardly from the protrusion portion of the hip plate.

5. The rifle holder device of claim 1 wherein the hip plate has two spaced apart protrusions with at least one leg extending outwardly from each protrusion.

6. The rifle holder device of claim 5 wherein each of the spaced apart protrusions has at least two legs extending outwardly therefrom.

7. The rifle holder device of claim 1 wherein the hip plate has two spaced apart protrusions with at least one leg extending outwardly from each of them and wherein a cradle is adjustably connected to the at least one leg extending from each protrusion, each cradle comprising a lower fork having at least two cradle fingers with at least one finger bore extending there through, the finger bore of the cradle being aligned with the leg bore having the pivot pin received therein to thereby connect the leg of the hip plate with the cradle fingers residing on either side of the leg.

8. The rifle holder device of claim 1 wherein the at least one leg has two leg bores extending there through.

9. The rifle holder device of claim 7 wherein the at least two cradle fingers have four finger bores extending through.

10. The rifle holder device of claim 1 further including an adjustable waist belt and shoulder strap so that the rifle holder device can be worn by different hunters.

11. A rifle holder device, which comprises:

a) a hip plate comprising an inner surface intended to rest against the hip of a user and an outer surface, wherein at least a portion of the outer surface of the hip plate has a generally vertical orientation when the rifle holder device is being worn;

b) at least one leg extending outwardly from the outer surface of the hip plate, wherein the at least one leg has at least one leg bore extending there through, the leg bore axis being aligned generally in a horizontal orientation;

c) at least one cradle adjustably connected to the hip plate and comprising an upstanding cradle portion extending from a lower cradle fork, the cradle fork comprising at least one cradle finder with there being either one more or one less cradle finger than there are legs extending from the hip plate, the at least one cradle finger having at least one finger bore extending there through, the cradle finger bore being aligned generally in a horizontal orientation and wherein the cradle is connectable to the hip plate with either two cradle fingers residing on either side of the at least one leg of the hip plate or two legs residing on either side of the at least one cradle finger and with the leg bore aligned with the cradle finger bore;

d) a pivot pin received in the aligned leg bore and the finger bore to connect the cradle to the hip plate;

e) a depending cradle portion extending downwardly from the cradle below the at least one cradle finger;

f) a threaded member comprising a threaded member head and a threaded shaft, wherein the threaded member head is received in an opening in the depending cradle portion with the threaded shaft extending in a horizontal orientation spaced below the at least one cradle finger connected to the at least one leg of the hip block;

g) a threaded sleeve threadingly received on the shaft of the threaded member with a sleeve head abutting an inner surface of the hip plate;

h) a coil spring residing on the cylindrical portion of the threaded sleeve threadingly received on the shaft of the threaded member and captured between the depending cradle portion and the hip plate;

i) wherein the threaded relationship between the threaded sleeve and the shaft is adjustable against the biasing force of the coil spring to adjust the tension between the cradle and the hip plate pivoting on the pivot pin to thereby adjust a holding force exerted on a rifle received between the hip plate and the cradle.

12. The rifle holder device of claim 11 wherein the at least one leg extends outwardly from a protrusion portion of the hip plate.

13. The rifle holder device of claim 12 wherein there are at least two legs extending outwardly from the protrusion portion of the hip plate.

14. The rifle holder device of claim 11 wherein the hip plate has two spaced apart protrusions with at least one leg extending outwardly from each protrusion.

15. The rifle holder device of claim 14 wherein each of the spaced apart protrusions has at least two legs extending outwardly therefrom.

16. The rifle holder device of claim 11 wherein the hip plate has two spaced apart protrusions with at least one leg extending outwardly from each of them and wherein a cradle is adjustably connected to the at least one leg extending from each protrusion, each cradle comprising a lower fork having at least two fingers with at least one finger bore extending there through, the finger bore of the cradle being aligned with the leg bore having the pivot pin received therein to thereby connect the leg of the hip plate with the cradle fingers residing on either side of the leg.

17. The rifle holder device of claim 10 further including an adjustable waist belt and shoulder strap so that the rifle holder device can be worn by different hunters.

18. A rifle holder device, which comprises:

a) a hip plate comprising an inner surface intended to rest against the hip of a user and an outer surface, wherein the hip plate has two spaced apart protrusions, each comprising a protrusion outer surface having a generally vertical orientation when the rifle holder device is being worn, wherein there are two legs extending outwardly from each protrusion with each of the legs having two leg bores extending there through, the leg bore axes being aligned generally in a horizontal orientation;

b) a cradle adjustably connected to each of the two protrusions of the hip plate, the cradles comprising an upstanding cradle portion extending from a lower cradle fork, the cradle fork comprising three fingers provided with four finger bores extending there through, the finger bores being aligned generally in a horizontal orientation and wherein the cradle is connectable to the hip plate with the hip plate legs residing between the cradle fingers having the cradle finger bores aligned with the leg bores;

c) pivot pins received in the aligned leg bores and the finger bores to connect the cradles to the respective protrusions of the hip plate;

d) a depending cradle portion extending downwardly from each cradle below the cradle fingers;

e) a threaded member comprising a threaded member head and a threaded shaft, wherein the threaded member head is received in an opening in the hip plate with the threaded shaft extending in a horizontal orientation spaced below the cradle fingers connected to the legs of the protrusions of the hip block;

f) a threaded sleeve threadingly received on the shaft of the threaded member with a sleeve head abutting an outer surface of the depending cradle portion;

g) a coil spring residing on the cylindrical portion of the threaded sleeve threadingly received on the shaft of the threaded member and each protrusion captured between the depending cradle portion and the hip plate;

h) wherein the threaded relationship between the threaded sleeve and the shaft is adjustable against the biasing force of the coil spring to adjust the tension between the cradle and the hip plate pivoting on the pivot pin to thereby adjust a holding force exerted on a rifle received between the protrusions of the hip plate and the cradles adjustably connected thereto.

19. The rifle holder device of claim 18 wherein the cradles are L-shaped.

20. The rifle holder device of claim 18 further including an adjustable waist belt and shoulder strap so that the rifle holder device can be worn by different hunters.

* * * * *